US005816078A

United States Patent [19]

Huang

[11] Patent Number: 5,816,078

[45] Date of Patent: Oct. 6, 1998

[54] MACHINE ADAPTED TO FADE THE COLOR OF JEANS

[76] Inventor: Yu-Min Huang, 329, Sec. 3, Chung Jeng Road, Jen Te Shiang, Tainan Shian, Taiwan

[21] Appl. No.: 900,543

[22] Filed: Jul. 25, 1997

[51] Int. Cl.[6] ..... D06B 1/10

[52] U.S. Cl. ..... 68/197; 68/10

[58] Field of Search ..... 68/197, 10, 210

[56] References Cited

U.S. PATENT DOCUMENTS

| | | | |
|---|---|---|---|
| 1,341,073 | 5/1920 | Rubenstein | 68/197 |
| 1,575,513 | 3/1926 | Sether | 68/197 |
| 2,520,064 | 8/1950 | Rones | 68/197 |
| 2,594,192 | 4/1952 | McArthur | 60/197 |
| 2,911,813 | 11/1959 | Stapf | 68/197 |
| 3,323,337 | 6/1967 | Graziano | 68/197 |

*Primary Examiner*—Frankie L. Stinson
*Attorney, Agent, or Firm*—Pro-Techtor Inter-National Services

[57] ABSTRACT

A machine adapted to fade the color of jeans, including a framework, a bleaching trough holding a bleaching solution for bleaching jeans, a carrier plate adapted to carry jeans and to move vertically between two upright guide bars of the framework for permitting carried jeans to be dipped in the bleaching solution for bleaching, a reversible motor controlled to move the carrier plate up and down, and two steel wires wound round pulleys at a cross beam of the framework and coupled between an output shaft of the reversible motor and the carrier plate and driven by the reversible motor to lift or lower the carrier plate for permitting carried jeans to be dipped in or taken out of the bleaching solution.

3 Claims, 3 Drawing Sheets

MACHINE ADAPTED TO FADE THE COLOR OF JEANS

BACKGROUND OF THE INVENTION

The present invention relates to a machine adapted to fade he color of jeans, and more particularly to such a machine which can be fully automatically controlled to bleach different parts of jeans at different length of times.

Regular jeans are commonly made in one color. In order to satisfy young people's demand, jeans may be bleached to fade before they put into the market. However, conventional bleaching techniques are not practical for fading different parts of jeans to different extends.

SUMMARY OF THE INVENTION

It is the main object of the present invention has to provide a machine for bleaching jeans which is practical for fading different parts of jeans to different extends. It is another object of the present invention to provide a machine for bleaching jeans which can be fully automatically controlled by a computer. According to the preferred embodiment of the present invention, the machine comprises a framework which comprises two parallel stands fixedly mounted on the ground, two upright supports respectively raised from the stands, two upright guide bars respectively raised from the stands in front of the upright supports, a cross beam fixedly mounted on the upright supports at a top side, pairs of bearing blocks respectively mounted on the cross beam at a front side, and a plurality of pulleys revolvably supported on the bearing blocks; a bleaching trough mounted on the ground between the parallel stands of the framework and holding a bleaching solution for bleaching jeans; a reversible motor mounted on the cross beam of the framework at a top side, having an elongated output shaft revolvably supported on bearing block means on the cross beam of the framework; a flat carrier plate adapted to hold jeans and to move vertically between the upright guide bars for permitting carried jeans to be dipped in the bleaching solution of the bleaching trough; a plurality of angle plates respectively fastened to a bottom side of the flat carrier plate and holding a respective clothespin for holding jeans for bleaching; and a plurality of steel wires respectively wound round the pulleys and having a respective top end fixedly fastened to the output shaft of the motor and a respective bottom end fixedly fastened to the flat carrier plate, the steel wires being taken up to lift the flat carrier when the reversible motor is turned forwards, the steel wires being let off to lower the flat carrier when the reversible motor is turned backwards.

DETAILED DESCRIPTION OF THE PREFERRED EMBODIMENT

Figure 1:
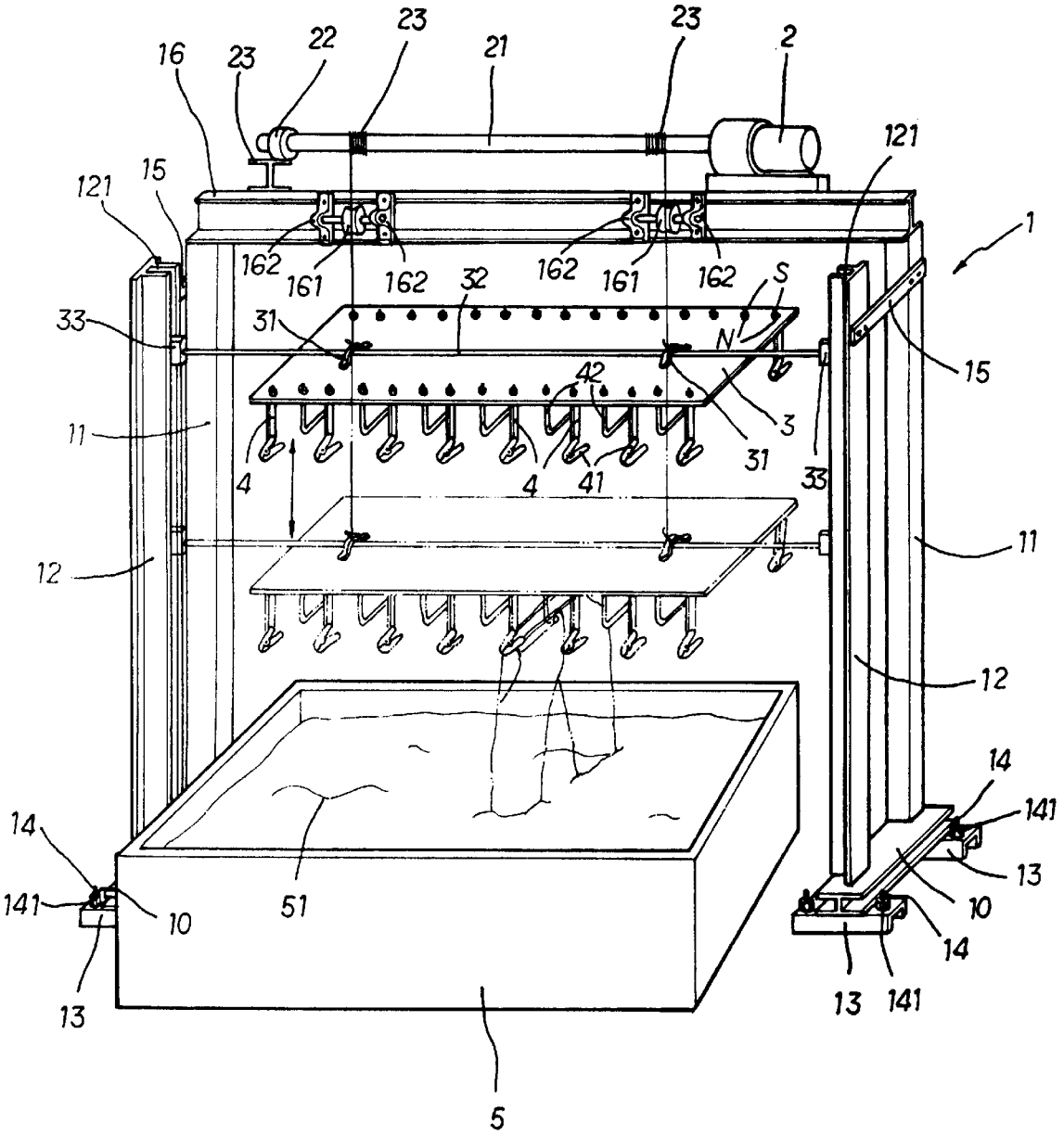
FIG. 1 is a perspective view of the present invention.
Figure 2:
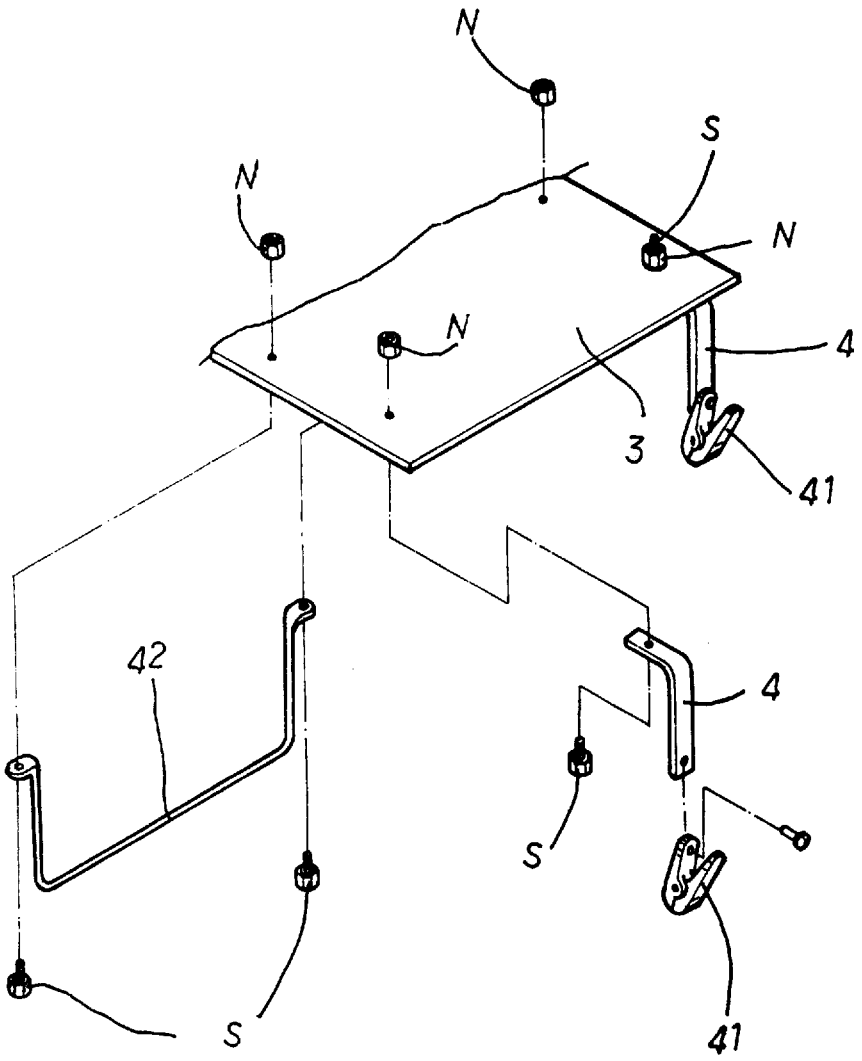
FIG. 2 is an exploded view of a part of the present invention.
Figure 3:
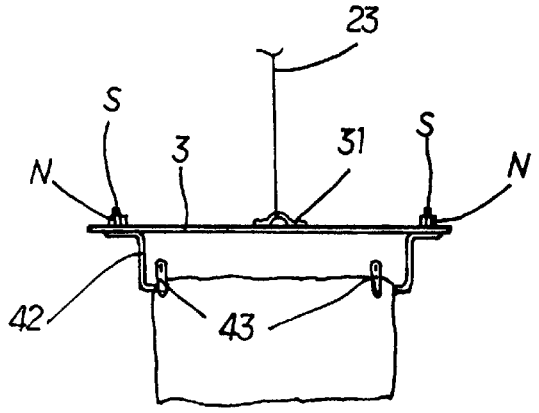
FIG. 3 is a sectional assembly view of FIG. 2, showing a piece of jeans suspended.

Referring to FIGS. 1, 2 and 3, a machine for fading the color of jeans in accordance with the present invention comprises a framework 1, a reversible motor 2, a flat carrier plate 3, and a bleaching trough 5.

The framework 1 comprises two symmetrical pairs of metal mounting frames 13 respectively fastened to the ground by anchoring studs 14 and lock nuts 141 and equally spaced from the bleaching trough 5 at two opposite sides, two horizontal stands 10 made from I-steel and respectively welded to the metal mounting frames 13, two metal upright supports 11 respectively welded to the horizontal stands 10, two upright guide bars 12 respectively welded to the horizontal stands 10 and disposed in parallel to the upright supports 11 and defining a respective vertical sliding groove 121 at an inner side, two metal cross bars 15 respectively fastened between the upright supports 11 and the upright guide bars 12, a cross beam 16 made from I-steel and welded to the upright supports 11 at the top, two pairs of bearing blocks 162 mounted on the cross beam 16 at a front side, and two pulleys 161 respectively and revolvably supported on the bearing blocks 162.

The reversible motor 2 is mounted on the cross beam 16 at the top, having an elongated output shaft 21 revolvably supported on a bearing block 22, which is supported on a supporting frame 23 at the top of the cross beam 16. Two steel wires 23 are respectively wound round the pulleys 161, having a respective top end fixedly fastened to the output shaft 21 of the reversible motor 2 and a respective bottom end fastened to the flat carrier plate 13. By turning the reversible motor 2 forwards or backwards, the steel wires 23 are taken up or let off, and therefore the flat carrier plate 13 is lifted or lowered.

The flat carrier plate 3 comprises two iron plates 31 bilaterally disposed at its top side and respectively fastened to the bottom ends of the steel wires 23, and a sliding rod 32 fixedly secured thereto and having two opposite ends terminating in a respective sliding block 33 adapted to move in the vertical sliding grooves 121 of the upright guide bars 12. Two longitudinal rows of angle plates 4 and a plurality of hanging rods 42 are fixedly fastened to the flat carrier plate 3 at its bottom side by screws S and nuts N. A plurality of clothespins 41;43 are respectively fastened to the angle plates 4 and the hanging rods 42 for securing jeans for treatment.

The bleaching trough 5 is mounted on the ground right below the flat carrier plate 3, holding a bleaching solution 51.

Figure 4:
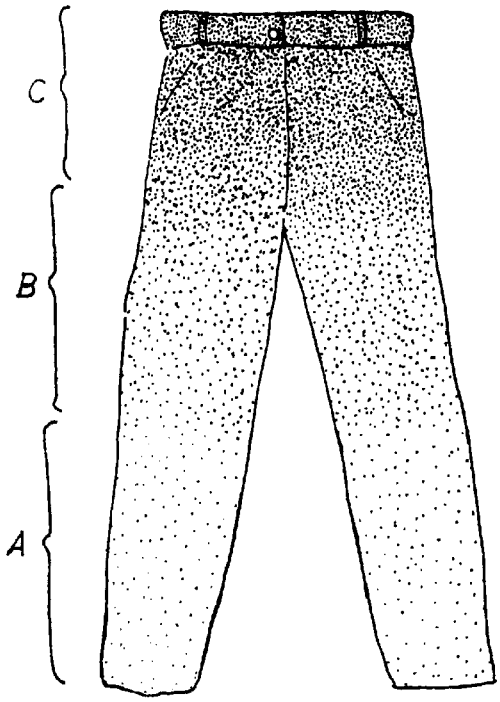
FIG. 4 shows a piece of jeans after treatment according to the present invention.

Referring to FIG. 4 and FIG. 1 again, when jeans are fastened to the clothespins 41;43, the reversible motor 2 is controlled to let off the steel wires 23 in lowering the flat carrier plate 3, permitting the jeans to be completely dipped in the bleaching solution 51 for treatment for a predetermined length of time, then the reversible motor 2 is turned reversely to take up the steel wires 23 in lifting the flat carrier plate 3 to a certain height for permitting the upper part C of each piece of jeans to be moved out of the bleaching solution 51 and the middle part B and lower part A of each piece of jeans to be maintained dipped in the bleaching solution 51, and then the reversible motor 2 is controlled to take up the steel wires 23 in lifting the flat carrier plate 3 to a relatively higher elevation a certain length of time after the upper part C of each piece of jeans has been moved out of the bleaching solution 51, for permitting the upper part C and middle part B of each piece of jeans to be disposed outside the bleaching trough 5 and the lower part A of each jeans to be maintained dipped in the bleaching solution 51, and then the reversible motor 2 is controlled to take up the steel wires 23 in lifting the flat carrier plate 3 in lifting the flat carrier plate 3 to the upper limit position a certain length of time after the upper part C and middle part B of each piece of jeans have been moved out of the bleaching trough 5, and then the treated pieces of jeans are taken away from the clothespins 41;43 to receive further washing and drying procedures. After treatment, the upper part C, middle part B and lower part A of each piece of jeans have different colors. The aforesaid bleaching solution 51 can be obtained by mixing one part of 12% sodium chlorate with about 1–5 parts of water for about 1–2 minutes. A bleaching solution obtained according to the present invention is not harmful to the workmen, and does not cause environmental pollution.

While only one embodiment of the present invention has been shown and described, it will be understood that various modifications and changes could be made thereunto without departing from the spirit and scope of the invention disclosed. For example, a computer-controlled central control unit may be provided to control the operation of the reversible motor 2 fully automatically.

What the invention claimed is:

1. A machine adapted to fade the color of jeans, comprising:

a framework, said framework comprising two parallel stands fixedly mounted on the ground, two upright supports respectively raised from said stands, two upright guide bars respectively raised from said stands in front of said upright supports, a cross beam fixedly mounted on said upright supports at a top side, pairs of bearing blocks respectively mounted on said cross beam at a front side, and a plurality of pulleys revolvably supported on said bearing blocks;

a bleaching trough mounted on the ground between the parallel stands of said framework and holding a bleaching solution for bleaching jeans;

a reversible motor mounted on the cross beam of said framework at a top side, having an elongated output shaft revolvably supported on bearing block means on the cross beam of said framework;

a flat carrier plate adapted to hold jeans and to move vertically between said upright guide bars for permitting carried jeans to be dipped in the bleaching solution of said bleaching trough;

a plurality of angle plates respectively fastened to a bottom side of said flat carrier plate and holding a respective clothespin for holding jeans for bleaching; and a plurality of steel wires respectively wound round said pulleys and having a respective top end fixedly fastened to the output shaft of said motor and a respective bottom end fixedly fastened to said flat carrier plate, said steel wires being taken up to lift said flat carrier when said reversible motor is turned forwards, said steel wires being let off to lower said flat carrier when said reversible motor is turned backwards.

2. The machine of claim 1, wherein said upright guide bars of said framework define a respective vertical sliding groove at an inner side; said flat carrier plate has a sliding rod fixedly secured thereto, said sliding rod having two opposite ends respectively terminating in a respective sliding block adapted to move in the vertical sliding grooves of said upright guide bars of said framework.

3. The machine of claim 1, wherein said flat carrier plate has a plurality of hanging rods at its bottom side for holding jeans by clothespins.

* * * * *